US008651974B2

(12) United States Patent
Guerriero

(10) Patent No.: US 8,651,974 B2
(45) Date of Patent: Feb. 18, 2014

(54) AERODYNAMIC GOLF CLUB

(75) Inventor: Charles Placido Guerriero, Brighton, MI (US)

(73) Assignee: Marie L. Guerriero, Brighton, MI (US)

( * ) Notice: Subject to any disclaimer, the term of this patent is extended or adjusted under 35 U.S.C. 154(b) by 406 days.

(21) Appl. No.: 13/066,039

(22) Filed: Apr. 6, 2011

(65) Prior Publication Data

US 2012/0258819 A1 Oct. 11, 2012

(51) Int. Cl.
*A63B 53/04* (2006.01)

(52) U.S. Cl.
USPC ..... 473/327

(58) Field of Classification Search
USPC ..... 473/324–350
See application file for complete search history.

(56) References Cited

U.S. PATENT DOCUMENTS

| | | | | | |
|---|---|---|---|---|---|
| 780,776 | A * | 1/1905 | Brown | 473/327 |
| 1,414,124 | A * | 4/1922 | Griffin | 473/242 |
| 1,671,956 | A * | 5/1928 | Sime | 473/329 |
| 3,003,768 | A * | 10/1961 | Clements | 473/327 |
| 3,468,544 | A * | 9/1969 | Antonious | 473/327 |
| 3,794,328 | A * | 2/1974 | Gordon | 473/327 |
| 4,253,667 | A * | 3/1981 | Clark et al. | 473/325 |
| 4,809,982 | A * | 3/1989 | Kobayashi | 473/327 |
| 4,869,508 | A * | 9/1989 | Miller | 473/328 |
| 5,000,455 | A * | 3/1991 | Beilfuss, Sr. | 473/328 |
| 5,054,784 | A * | 10/1991 | Collins | 473/327 |
| 5,090,703 | A * | 2/1992 | Koumarianos | 473/328 |
| 5,158,296 | A * | 10/1992 | Lee | 473/327 |
| 5,524,890 | A * | 6/1996 | Kim et al. | 473/242 |
| 5,529,303 | A * | 6/1996 | Chen | 473/327 |
| 5,785,609 | A * | 7/1998 | Sheets et al. | 473/327 |
| 5,807,187 | A * | 9/1998 | Hamm | 473/327 |
| 5,908,357 | A * | 6/1999 | Hsieh | 473/327 |
| 5,944,614 | A * | 8/1999 | Yoon | 473/224 |
| 6,471,602 | B1 * | 10/2002 | D'Orazio | 473/324 |
| 6,482,106 | B2 * | 11/2002 | Saso | 473/327 |
| 6,824,474 | B1 * | 11/2004 | Thill | 473/327 |
| 6,969,325 | B1 * | 11/2005 | Harrelson | 473/327 |
| 7,473,185 | B2 * | 1/2009 | Anderson et al. | 473/325 |

FOREIGN PATENT DOCUMENTS

| | | | | |
|---|---|---|---|---|
| DE | 19649747 | C1 * | 4/1998 | A63B 53/04 |
| GB | 2213390 | A * | 8/1989 | A63B 53/04 |
| JP | 04038970 | A * | 2/1992 | A63B 53/04 |
| JP | 04138179 | A * | 5/1992 | A63B 53/04 |
| JP | 05277213 | A * | 10/1993 | A63B 53/04 |
| JP | 06142237 | A * | 5/1994 | A63B 53/04 |
| JP | 08071188 | A * | 3/1996 | A63B 53/04 |
| JP | 08266689 | A * | 10/1996 | A63B 53/04 |
| JP | 09075486 | A * | 3/1997 | A63B 53/04 |
| JP | 09294834 | A * | 11/1997 | A63B 53/04 |
| JP | 10263116 | A * | 10/1998 | A63B 53/04 |
| JP | 2000140168 | A * | 5/2000 | A63B 53/04 |

(Continued)

*Primary Examiner* — Alvin Hunter
(74) *Attorney, Agent, or Firm* — Charles P. Guerriero

(57) ABSTRACT

A "Aerodynamic Golf Club Assembly" is designed for a minimal amount of air resistance to the face of the club head when it's in a forward swing mode. This allows the golfer to swing the club head at a higher speed, which will cause the ball to travel a longer distance. This is done by means of one or more fore and aft straight round holes that protrude from the face of the head through the hill of the head. The hill of the head has a concave surface, so a stronger vacuum is created during a forward swing mode of the head.

1 Claim, 1 Drawing Sheet

(56) References Cited

FOREIGN PATENT DOCUMENTS

| | | | | | |
|---|---|---|---|---|---|
| JP | 2001314536 A | * | 11/2001 | ..... | A63B 53/04 |
| JP | 2002085606 A | * | 3/2002 | ..... | A63B 53/04 |
| JP | 2008194116 A | * | 8/2008 | | |
| JP | 2009034449 A | * | 2/2009 | | |

* cited by examiner

INVENTOR Charles P. Guerriero
WITNESS
12-1-10
12-1-10
HEAD

AERODYNAMIC GOLF CLUB

DESCRIPTION OF THE PRIOR ART

The present golf club assembly has a club head with no fore and aft holes protruding through the head. This club head during a forward swing mode has a lot of air resistance to the face of the club head, which causes a reduced speed of the head, and causes the ball to travel a shorter distance to its target. This same golf club head does not have a concave surface at the hill of the head that produces a partial vacuum at a center hole that allows the air flow through the hole to suck the ball to the sweet spot of the head, which gives the ball a inaccurate direction to its target.

BRIEF SUMMARY OF THE DISCLOSURE

A "Aerodynamic Golf Club Assembly" consisting of a golf shaft and grip which is attached to the golf club head. The club head has one or more holes that protrude from the face of the head to the hill of the head, and one centerline of a hole is on the same centerline of the club head, the centerline of the club head is a line drawn from the center of gravity of the head to a perpendicular line that is on the front flat face surface of the head, and parallel to the ground, this hole will allow the air flow from the front of the head to flow to the rear of the head and the flow of air will suck the golf ball to the club head sweet spot during a forward swing mode. The hill of the head has a concave surface, so a stronger vacuum is created during a forward swing mode of the club head. This partial vacuum at the center hole will suck more air from the front face of the head and suck the golf ball to the sweet spot of the head. This will give the golfer more accuracy of the ball going to its target, and allows the golfer to swing the club head at a higher speed (mph), because it has less air resistance at the face of the head.

The claims for this invention are for any size golf club and is made of any type of material.

BRIEF DESCRIPTION OF DRAWING

A "Aerodynamic Golf Club Assembly" has four views shown as follows.

DETAIL DESCRIPTION OF THE PRESENTLY PREFERRED EMBODIMENT

Figures 1, 2, 3, 4:
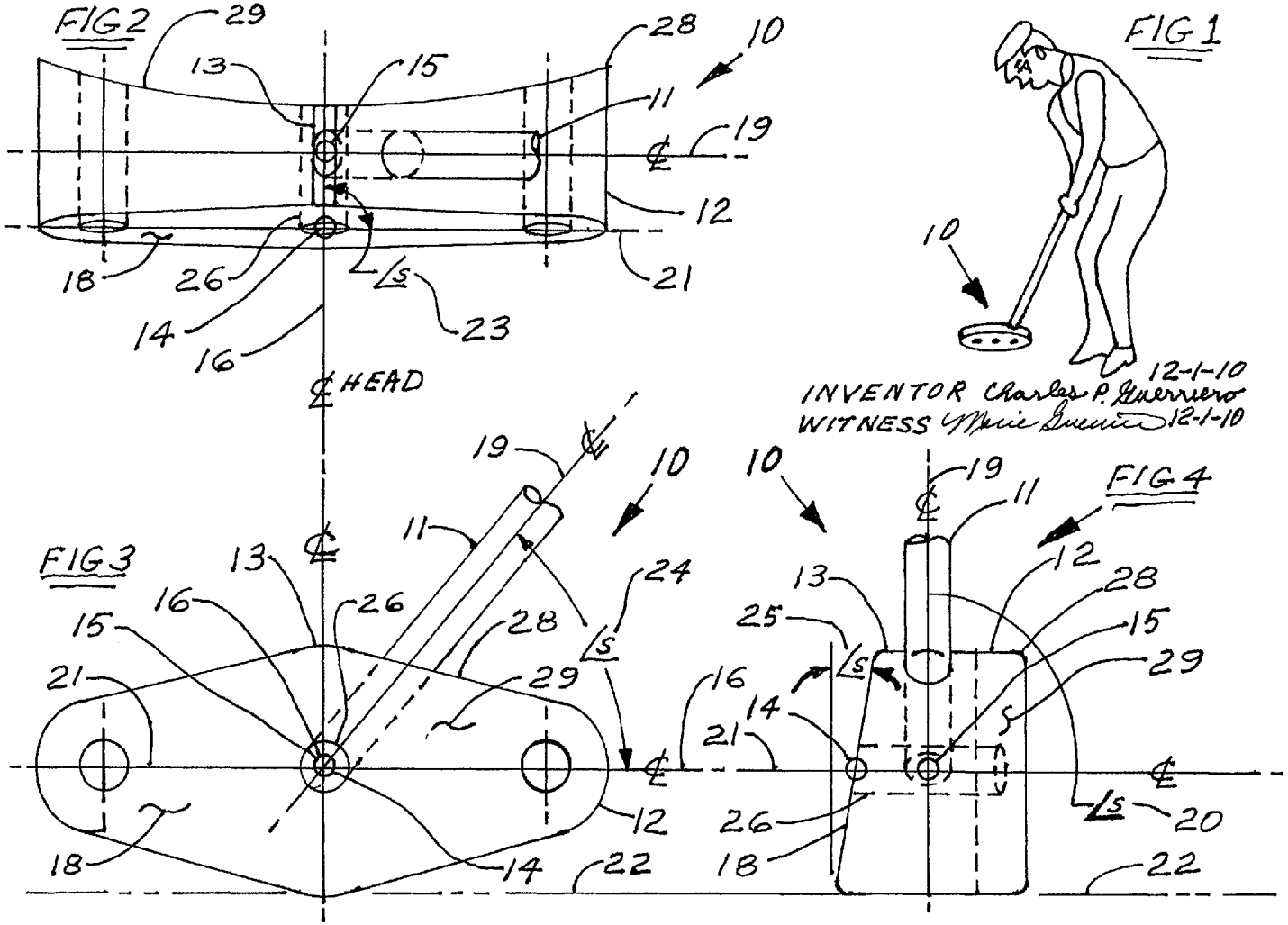
FIG. 1 is an elevation view of a golfer using a "Aerodynamic Golf Club Assembly".
FIG. 2 is a plan view of the golf head and shaft of the present invention with the shaft broken away.
FIG. 3 is a front view of the golf head and shaft of this invention with part of the shaft broken away.
FIG. 4 is a side view of the golf head and shaft of this invention with part of the shaft broken away.

Referring now to the drawings where in the presently preferred embodiment of this invention is illustrated. FIG. 1 disclosed a "Aerodynamic Golf Club Assembly" 10 being used by any golfer. FIGS. 2, 3, and 4 contains a golf club head 12 has one or more straight round holes 26 protruding through the club head 12 in a fore and aft direction. The one of many holes 26 has a centerline 16 on center with the centerline 16 of the club head 12. The hill 28 of the club head 12 has a concave surface 29. The centerline 19 of the grip and shaft 11 is attached to the club head 12 so that it will intersect with the center-line 16 and the center of gravity 15 of the club head 12. The centerline 16 of the head 12 is drawn from the center of gravity 15 to a perpendicular line 21 that is parallel to the ground 22 and is on the flat face surface 18 of the head 12. The sweet spot 14 is a spot where the center-line 16 of the head 12 will pierce the surface plane 18 at point 14. This club head 12 includes a highlighted straight line 13 above and parallel to the center-line 16 of the club head 12. and has a angle 23 of 90 degrees to line 21 in the top view FIG. 2. The lie angle 24 is of any degrees. The loft angle 25 is of any degrees. The center-line 19 of the shaft 11 to line 16 has a angle 20 of any degrees In the end view FIG. 4

OPERATION

Any golfer can use a "Aerodynamic Golf Club Assembly" at any time or any place. The Golfer must align the sweet spot of the head with the center of the ball, and align the sight line of the club head, so as to coincide with a imaginary line that is drawn from the center of the ball to its target. He then should re-grip the club shaft after this adjustment and keep the desired club head position that was set for the club head intact. He is now ready to drive the ball to its target. When addressing the golf ball, the sweet spot of the club head should contact the ball and it will drive the ball further and with more accuracy to its target, because the ball is suck to its sweet spot on the face of the head, and the forward stroke mode has less air resistance at the face of the club, which gives the golf ball more distance of travel to its target.

The invention claimed is:

1. A golf club head comprising:

a front face for striking a golf ball wherein the front face is planar in a direction perpendicular to a ground;

a toe end;

a heel end;

a rear surface opposite the front face wherein the rear surface is concave in the heel to toe direction;

one or more straight round holes extending through the front face to the rear surface wherein a centerline of one of the one or more straight round holes coincides with a center of gravity centerline extending from the front face to the rear surface of the club head.

* * * * *